US011574591B2

(12) United States Patent
Lee et al.

(10) Patent No.: US 11,574,591 B2
(45) Date of Patent: Feb. 7, 2023

(54) DISPLAY DEVICE

(71) Applicant: Samsung Display Co., Ltd., Yongin-Si (KR)

(72) Inventors: Jae Hoon Lee, Yongin-si (KR); Myeong Su Kim, Yongin-si (KR); Jae Woo Ryu, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/381,134

(22) Filed: Jul. 20, 2021

(65) Prior Publication Data

US 2022/0108656 A1 Apr. 7, 2022

(30) Foreign Application Priority Data

Oct. 6, 2020 (KR) ..... 10-2020-0129013

(51) Int. Cl.
*G09G 3/3233* (2016.01)
*G09G 3/3275* (2016.01)
*G09G 3/3266* (2016.01)

(52) U.S. Cl.
CPC ..... *G09G 3/3233* (2013.01); *G09G 3/3266* (2013.01); *G09G 3/3275* (2013.01); *G09G 2300/0426* (2013.01); *G09G 2300/0819* (2013.01); *G09G 2310/08* (2013.01); *G09G 2320/0295* (2013.01); *G09G 2320/045* (2013.01); *G09G 2330/10* (2013.01)

(58) Field of Classification Search
None
See application file for complete search history.

(56) References Cited

U.S. PATENT DOCUMENTS

2020/0184898 A1* 6/2020 Choi ..... G09G 3/3233

* cited by examiner

*Primary Examiner* — Christopher J Kohlman
(74) *Attorney, Agent, or Firm* — Innovation Counsel LLP

(57) ABSTRACT

A display device includes pixels connected to scan lines, sensing lines, readout lines, and data lines; a scan driver including stages to supply a scan signal and a sensing signal to the scan lines and the sensing lines; a data driver which supplies a data signal to the data lines; a timing controller which divides one frame into an active period including a scan period in which the data signal is supplied to the data lines and a display period in which the pixels emit light in response to the data signal, and a blank period including a sensing period in which electrical characteristics of the pixels are detected and a reset period in which the stages are reset; and a compensator which generates a compensation value for compensating for deterioration of the pixels based on sensing values provided from the readout lines during the sensing period.

20 Claims, 11 Drawing Sheets

DISPLAY DEVICE

This application claims priority to Korean Patent Application No. 10-2020-0129013, filed on Oct. 6, 2020, and all the benefits accruing therefrom under 35 U.S.C. § 119, the content of which in its entirety is herein incorporated by reference.

BACKGROUND

1. Field

The present disclosure relates to a display device, and more particularly, to a display device having a variable drive frequency (or frame rate).

2. Description of the Related Art

A display device includes a pixel unit including a plurality of pixels and a driver that drives the pixel unit. The driver displays an image on the pixel unit by using an image signal received from an external graphic processor. The graphic processor may generate an image signal by rendering raw data, and a rendering time for generating the image signal corresponding to one frame may vary depending on the type or characteristics of an image. The driver may vary a frame rate according to the rendering time.

Meanwhile, the pixel may include a pixel circuit including a plurality of transistors and capacitors and a light emitting element. When a scan signal is supplied from a scan line, the pixel circuit may receive a data voltage from a data line and may supply a current of a drive transistor according to the data voltage to the light emitting element. The light emitting element may emit light with an intensity corresponding to the current of the drive transistor.

There may be a problem in that a desirable gray level is not implemented because a variation is made in electrical characteristics (or threshold voltage and mobility) of a drive transistor between pixels due to a process variation, deterioration, or so on and. In order to solve this problem, an external compensation method of externally compensating for an electrical characteristic variation of a drive transistor during a vertical blank period between active periods is used.

SUMMARY

A scan driver may include a plurality of stages. According to an embodiment, all stages (or a first node of the stage) may be reset by a scan start signal at each start point in time of a frame. In this case, a voltage applied to the first node of the stage may be a voltage for controlling an output of a scan signal and a carry signal.

When a frame rate is varied, a vertical blank period is also varied, and thus, a reset period of the first node of the stage may not be constant. In this case, the stage may provide the scan signal to a pixel row on which external compensation is performed. As the time when a voltage of a high level is applied to the first node of the stage is increased, deterioration of transistors (for example, oxide semiconductor transistors) connected to the first node of the stage may be increased.

In addition, the number of turn-offs of light emitting elements per unit time is changed due to a change in the frame rate, and this difference may be perceived as a change in luminance and/or flicker of an image. In order to solve this problem, research on a technology is being conducted in which an additional light emission-off period is inserted into a blank period when driven at a frame rate lower than a previous frame rate, thereby preventing a decrease in luminance. However, there may be a problem in that, when all stages are reset by using a scan start signal at every start point in time (or every time when a scan signal and/or a sensing signal is output) of a frame, the light emission-off period is not sufficiently obtained.

An object to be achieved by the present disclosure is to reset a first node of a stage in a display device having a variable drive frequency for each constant cycle.

Another object to be achieved by the present disclosure is to sufficiently obtain a light emission-off period even when a difference between drive frequencies is not an integer multiple difference in a display device having a variable drive frequency.

The objects of the present disclosure are not limited to the technical objects described above, and other technical objects that are not described will be clearly understood by those skilled in the art from the following description.

A display device according to an embodiment of the present disclosure includes a plurality of pixels, each of the plurality of pixels respectively connected to scan lines, sensing lines, readout lines, and data lines; a scan driver including a plurality of stages and configured to supply a scan signal and a sensing signal to each of the scan lines and the sensing lines, respectively; a data driver configured supply a data signal to each of the data lines; a timing controller configured to divide one frame into an active period including a scan period in which the data signal is supplied to each of the data lines and a display period in which the pixels emit light in response to the data signal, and a blank period including a sensing period in which electrical characteristics of the pixels are detected and a reset period in which the stages are reset, based on an external control signal; and a compensator configured to generate a compensation value for compensating for deterioration of the pixels based on sensing values provided from the readout lines during the sensing period.

A start point in time of the reset period substantially coincides with an end point in time of the sensing period.

The sensing period may be performed for at least one of the scan lines during the blank period.

The timing controller may supply a scan start signal for starting the scan period to the scan driver at least once during one frame and supply a reset signal for starting the reset period to the scan driver once during one frame.

The $n^{th}$ (n is a natural number) stage of the plurality of stages may include a first input unit which precharges a voltage of a first node in response to a carry signal of a previous stage supplied to a first input terminal; a second input unit which discharges the voltage of the first node in response to a carry signal of a next stage supplied to a second input terminal; a first controller which discharges a voltage of a first output terminal for outputting an $n^{th}$ carry signal in response to the carry signal of the next stage; and an output unit which is connected to a scan clock input terminal, a carry clock input terminal, a sensing clock input terminal, a first power input terminal to which a first power is supplied, and a second power input terminal to which a second power is supplied, and outputs an $n^{th}$ scan signal corresponding to a scan clock signal supplied to the scan clock input terminal in response to the voltage of the first node and a voltage of a second node, an $n^{th}$ carry signal corresponding to a carry clock signal supplied to the carry clock input terminal, and an $n^{th}$ sensing signal corresponding to a sensing clock signal supplied to the sensing clock input terminal in response to the voltage of the second node to the first output terminal, a carry output terminal, and a second output terminal, respectively.

The display device may further include a reset unit which resets the voltage of the first node to the second power in response to a reset signal supplied to a fourth input terminal.

The plurality of stages may simultaneously receive the reset signal.

The display device may further include a leakage controller which supplies a control voltage supplied to a third input terminal to the first input unit and the second input unit in response to the $n^{th}$ scan signal and the $n^{th}$ sensing signal.

The display device may further include a second controller which holds the voltage of the first node as a gate-off voltage in response to the voltage of the second node, and a third controller which controls the voltage of the second node in response to the scan clock signal and the $n^{th}$ carry signal.

The scan clock signal, the carry clock signal, and the sensing clock signal may be output at a same timing during the display period and are output at different timings during the sensing period.

The blank period may include a first period, a second period, a third period, and a fourth period, and the first, second, third, and fourth periods are disposed consecutively, the scan clock signal may have a gate-on voltage during the first period and the third period, the sensing clock signal may have a gate-on voltage during the first, second, and third periods, and the reset signal may have the gate-on voltage during the fourth period.

The carry clock signal may have a gate-off voltage during the blank period.

Each of the first and second input units, the first, second, and third controllers, the output unit, the leakage controller, and the reset unit may be made of an oxide semiconductor transistor.

The reset unit may include a plurality of first transistors which are connected in series and disposed between the second power input terminal and the first node and have gate electrodes which are connected in common to the fourth input terminal.

The first input unit may include a second transistor which is disposed between the first input terminal and the first node and has a gate electrode connected to the first input terminal, the second input unit may include a third transistor which is disposed between the second power input terminal and the first node and has a gate electrode connected to the second input terminal, the first controller may include a fourth transistor which is disposed between the first output terminal and the first power input terminal and has a gate electrode connected to the second input terminal, and the output unit may include a firth transistor which is disposed between the clock input terminal and the first output terminal and has a gate electrode connected to the first node, a sixth transistor which is disposed between the first output terminal and the first power input terminal and has a gate electrode connected to the second node, a seventh transistor which is disposed between the clock input terminal and the carry output terminal and has a gate electrode connected to the first node, an eighth transistor which is disposed between the carry output terminal and the second power input terminals and has a gate electrode connected to the second node, a ninth transistor which is disposed between the sensing clock input terminal and the second output terminal, and has a gate electrode connected to the first node, and a tenth transistor which is disposed between the second output terminal and the second power input terminal and has a gate electrode connected to the second node.

The second controller may include a ninth transistor which is disposed between the first node and the second power input terminal and has a gate electrode connected to the second node.

The third controller may include a twelfth transistor disposed between the clock input terminal and the second node, a thirteenth transistor disposed between the second node and the second power input terminal, and fourteenth and fifteenth transistors arranged in series and disposed between the scan clock input terminal and the first the power input terminal, a gate electrode of the twelfth transistor may be connected to a common node which is disposed between the fourteenth transistor and the fifteenth transistor, gate electrodes of the thirteenth transistor and the fifteenth transistor may be connected to the carry output terminal, and a gate electrode of the fourteenth transistor may be connected to the scan clock input terminal.

The leakage controller may include a $16A^{th}$ transistor which is disposed between the third input terminal and the third node, and has a gate electrode connected to the first output terminal; and a $16B^{th}$ transistor which is disposed between the third input terminal and the third node, and has a gate electrode connected to the second output terminal.

The timing controller may generate a count signal in which time of the blank period is counted, and supply a start signal for outputting the sensing signal to the scan driver when the count signal reaches a reference value.

The reference value may be a length of a first blank period corresponding to a maximum frame rate set in the display device.

When a sensed frame rate based on the control signal is less than the maximum frame rate, the blank period may include the first and second blank periods, which are disposed consecutively, and the scan driver may supply the sensing signal to the sensing line during a first period included in the second blank period based on the start signal.

In a display device having a variable drive frequency according to an embodiment of the present disclosure, a first node of a stage may be reset periodically by applying a reset signal separately from a scan start signal immediately after external compensation.

In the display device having a variable drive frequency according to the embodiment of the present disclosure, a light emission-off period may be sufficiently obtained even when a difference between drive frequencies is not an integer multiple difference by applying a reset signal separately from a scan start signal immediately after external compensation.

Effects according to the present disclosure are not limited by the content described above, and more various effects are included in the specification.

DETAILED DESCRIPTION

Figure 1:
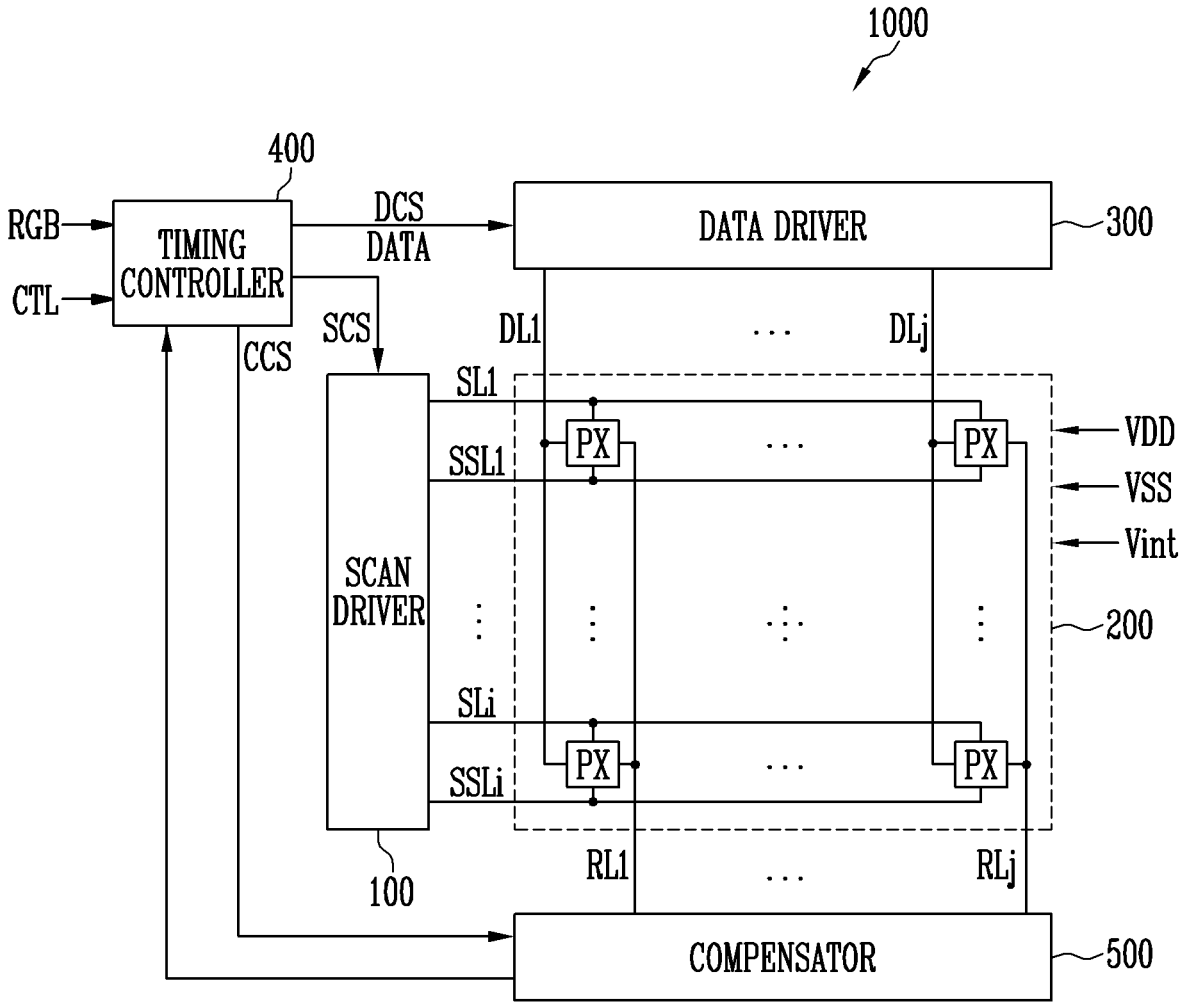
FIG. 1 is a block diagram illustrating a display device according to an embodiment of the present disclosure.

Hereinafter, preferred embodiments of the present disclosure will be described in more detail with reference to the accompanying drawings. The same reference numerals are used for the same configuration elements in the drawings, and description on the same configuration elements will not be repeated.

FIG. 1 is a block diagram illustrating a display device according to an embodiment of the present disclosure.

Referring to FIG. 1, a display device 1000 may include a scan driver 100, a pixel unit 200, a data driver 300, a timing controller 400, and a compensator 500.

The display device 1000 may be a flat display device, a flexible display device, a curved display device, a foldable display device, or a bendable display device. In addition, the display device may be applied to a transparent display device, a head-mounted display device, a wearable display device, or so on.

The display device 1000 may be implemented as a self-luminous display device including a plurality of self-luminous elements. For example, the display device 1000 may be an organic light emitting display device including organic light emitting elements, a display device including inorganic light emitting elements, or a display device including light emitting elements composed of a combination of inorganic and organic materials. However, this is only an example, and the display device 1000 may also be implemented as a liquid crystal display device, a plasma display device, a quantum dot display device, or so on.

In one embodiment, the display device 1000 may be driven by being divided into an active period for displaying an image and a blank period of which a length changes according to a change in a frame rate (frame frequency). The length of the blank period may be adjusted to reduce a discrepancy between frame information supplied from an external host system (for example, a graphic processor, an application processor, or so on) and timing at which the display device 1000 outputs an image frame.

The timing controller 400 may generate a data driving control signal DCS, a scan driving control signal SCS, and a compensation driving control signal CCS in response to a control signal CTL supplied from an external source. The data driving control signal DCS generated by the timing controller 400 may be supplied to the data driver 300, the scan driving control signal SCS may be supplied to the scan driver 100, and the compensation driving control signal CCS may be supplied to the compensator 500. In addition, the timing controller 400 may supply the data driver 300 with image data DATA in which the image signal RGB supplied from an external source is rearranged.

The data driving control signal DCS may include a source start signal and clock signals. The source start signal controls a sampling start point in time of data. The clock signals may be used to control a sampling operation.

The scan driving control signal SCS may include a scan start signal STV (see FIG. 9) and the clock signals. The scan start signal SW controls a first timing of the scan signal. The clock signals may be used to shift the scan start signal STV.

The compensation driving control signal CCS may control driving of the compensator 500 for sensing and compensating for deterioration the pixel PX.

In one embodiment, the timing controller 400 may divide one frame into an active period and a blank period based on the control signal CTL. The timing controller 400 may count a length of the blank period and generate a count signal. The timing controller 400 may supply the scan driver 100 with the start signal for outputting a sensing signal supplied to sensing lines SSL1 to SSLi based on the count signal.

The scan driver 100 may receive the scan driving control signal SCS from the timing controller 400. The scan driver 100 that receives the scan driving control signal SCS may supply scan signals to scan lines SL1 to SLi (i is a natural number). According to one embodiment, the scan driver 100 may sequentially supply the scan signals to the scan lines SL1 to SLi. When the scan signals are sequentially supplied to the scan lines SL1 to SLi, pixels PX may be selected for each horizontal line (or pixel row). To this end, the scan signal may be set to a gate-on voltage (for example, a logic high level) so that transistors included in the pixels PX are turned on.

In addition, the scan driver 100 may receive the scan driving control signal SCS from the timing controller 400. The scan driver 100 that receives the scan driving control signal SCS may supply sensing signals to the sensing lines SSL1 to SSLi.

According to one embodiment, timing and waveforms at which the scan signal and the sensing signal are supplied may be set differently according to an active period, a sensing period, a blank period, and so on.

The data driver 300 may receive the data driving control signal DCS from the timing controller 400. The data driver 300 that receives the data driving control signal DCS may supply a data signal (or a data voltage) for displaying an image to data lines DL1 to DLj (j is a natural number) during a display period. The data signal may be a data voltage for displaying an effective image, that is, a voltage corresponding to the image data DATA. The data signal supplied to the data lines DL1 to DLj may be supplied to the pixels PX selected by the scan signal. To this end, the data driver 300 may supply the data signal to the data lines DL1 to DLj to be synchronized with the scan signal.

In addition, the data driver 300 that receives the data driving control signal DCS may supply a data voltage for detecting electrical characteristics of the pixel PX to the data lines DL1 to DLj during a sensing period.

The pixel unit 200 includes the pixels PX connected to the scan lines SL1 to SLi, the sensing lines SSL1 to SSLi, the data lines DL1 to DLj, and readout lines RL1 to RLj. The pixel unit 200 may receive a first drive power VDD and a second drive power VSS from the outside.

The compensator 500 may generate a compensation value for compensating for deterioration of the pixels PX based on sensing values provided from the readout lines RL1 to RLj. For example, the compensator 500 may detect and compensate for a change in a threshold voltage and, a change in mobility of a drive transistor TR1 (see FIG. 3) included in the pixel PX and a characteristic change of an organic light emitting diode included in the pixel PX.

In one embodiment, the compensator 500 may receive a current or a voltage extracted from the pixel PX through the readout lines RL1 to RLj during a sensing period. The extracted current or voltage corresponds to a sensing value, and the compensator 500 may detect a characteristic change of the first transistor TR1 and/or the light emitting element LD based on a change amount of the sensing value. The compensator 500 may calculate a compensation value for compensating for the image data DATA and/or a data signal based on the detected characteristic change. The compensation value may be provided to the timing controller 400 or the data driver 300.

During a display period, the compensator 500 may supply a predetermined reference voltage Vint (see FIG. 3) for displaying an image to the pixel unit 200 through the readout lines RL1 to RLj.

In one embodiment, transistors included in the display device 1000 may be n-type oxide thin film transistors. For example, the oxide thin film transistors may be low temperature polycrystalline oxide (LTPO) thin film transistors. However, this is an example, and the n-type transistors are not limited thereto. For example, active patterns (semiconductor layers) included in the transistors may include an inorganic semiconductor (for example, amorphous silicon or poly silicon), an organic semiconductor, or so on.

However, this is an example, and at least one of the transistors included in the display device 1000 may also be replaced with a p-type transistor. For example, the p-type transistor may be a p-channel metal oxide semiconductor (PMOS) transistor.

Figure 2:
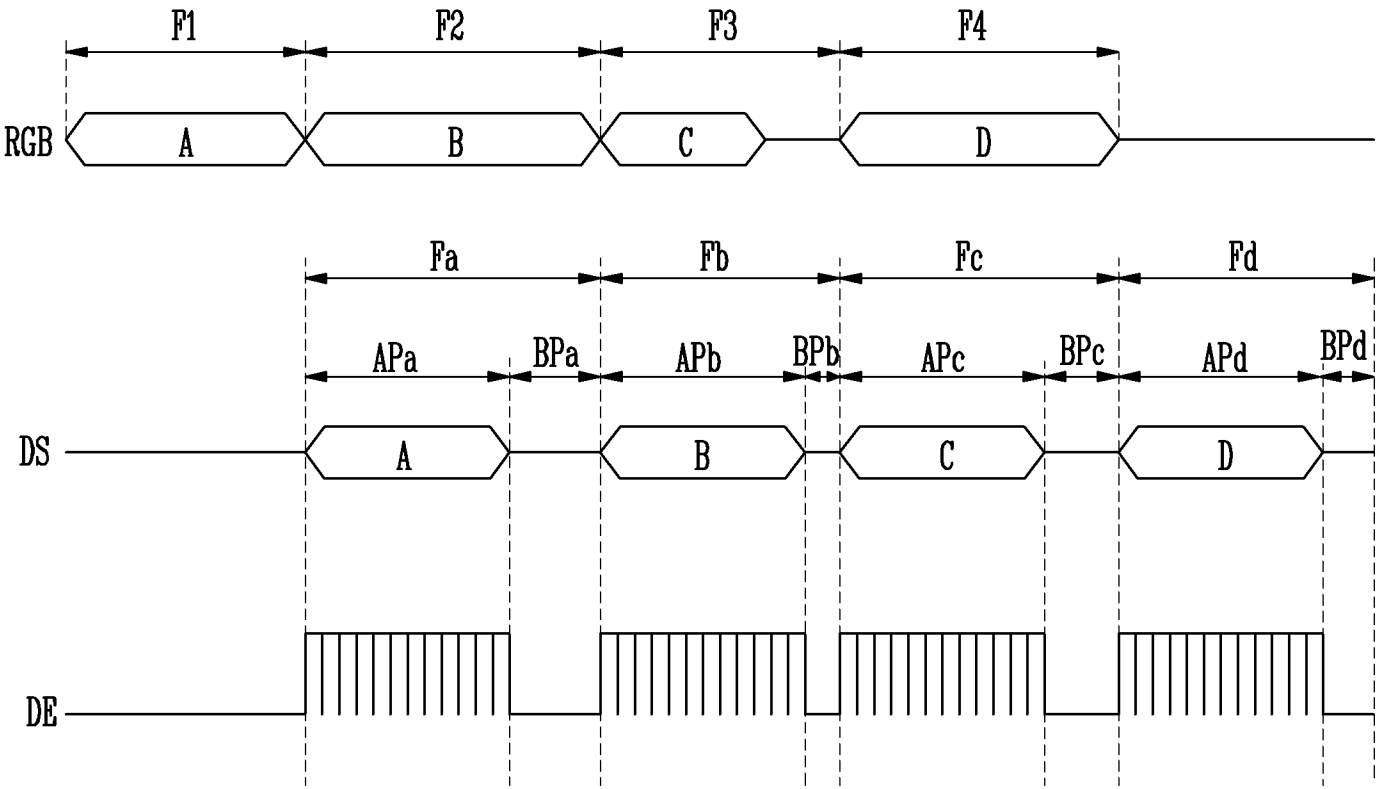
FIG. 2 is a diagram illustrating an example of driving a display device according to an image signal supplied from the outside.

FIG. 2 is a diagram illustrating an example of driving of a display device according to an image signal supplied from the outside.

Referring to FIGS. 1 and 2, an image signal RGB supplied from an external source may be a signal rendered by a graphic processor or the like. A frame rate of the image signal RGB may be changed according to rendering time of the graphic processor.

In the following description, the frame rate indicates a frame frequency, that is, the number of frames transferred per second (frame per second). The larger the frame rate, the shorter the time length and blank period of one frame, and the smaller the frame rate, the longer the time length and blank period of one frame.

In one embodiment, when the frame rate of the image signal RGB changes according to the rendering time of the graphic processor, the frame rate of the display device 1000 may also be changed.

The image signal RGB may be signal-processed by the timing controller 400, delayed by one frame, and output as a data signal DS or a data voltage. In one embodiment, the data signal DS may be output based on a data enable signal DE supplied from the timing controller 400.

The frame rate of the display device 1000 is the same as a frame rate of a frame delayed by one frame of the image signal RGB received from the outside. For example, a frame rate of a frame Fa in which an "A" data signal DS of the display device 1000 is output may be the same as a frame rate of a frame F2 in which a "B" image signal RGB is received. A frame rate of a frame Fb in which the "B" data signal DS of the display device 1000 is output may be the same as a frame rate of a frame F3 in which a "C" image signal RGB is received.

One frame of the display device 1000 may include an active period and a blank period in which the data signal DS is output. Time lengths of active periods APa, APb, APc, and APd in which "A", "B", "C", and "D" data signals DS are output in each of the frames Fa, Fb, Fc, and Fd may be the same as each other. In one embodiment, each of the active periods APa, APb, APc, and APd may include a scan period in which the data signal DS is written to the pixel.

Time lengths of blank periods (BPa, BPb, BPc, and BPd) may be changed according to differences between the frame rates of the frames Fa, Fb, Fc, and Fd and the active periods APa, APb, APc, and APd.

As depicted in FIG. 2, the frame rate of the frame Fa in which the "A" data signal DS is output is lower than the frame rate of the frame Fb in which the "B" data signal DS is output, and thus, the time length of the blank period BPa may be longer than the time length of the blank period BPb.

In this way, even when the frame rate changes irregularly, image tearing due to discrepancy between frame generation of a graphic processor and frame output of the display device, and an input lag in which some of an input frame disappears may be improved because lengths of the blank periods BPa, BPb, BPc, and BPd of the respective frames Fa, Fb, Fc, and Fd are controlled.

Figure 4:
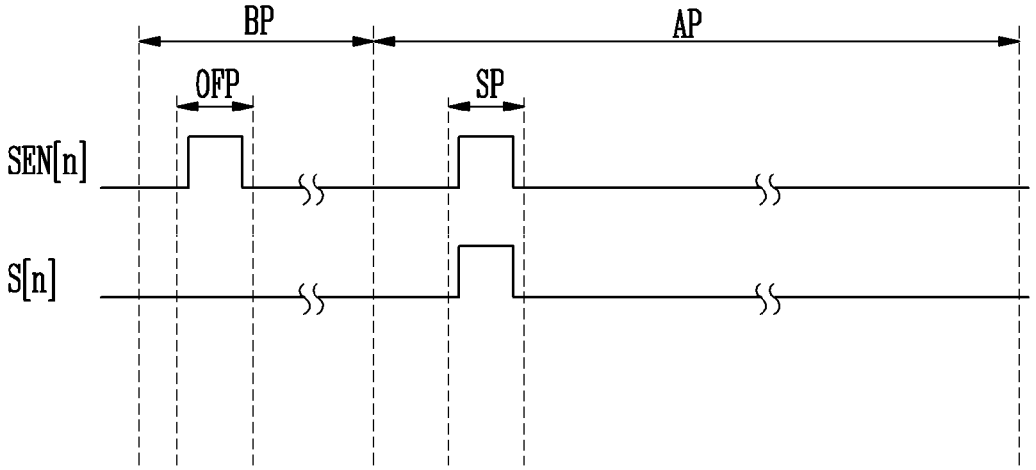
FIG. 4 is a waveform diagram illustrating an example of operation of the pixel of FIG. 3.
Figure 5:
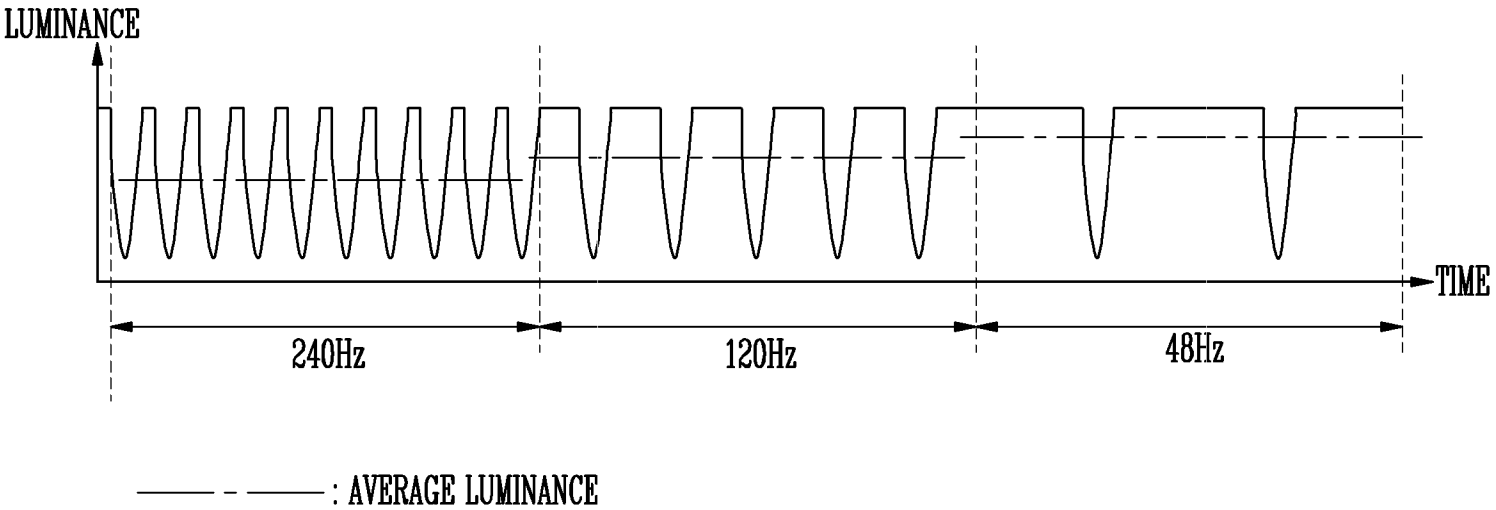
FIG. 5 is a diagram illustrating an example of a change in luminance of an image according to a frame rate.

However, a change in luminance or flicker may be recognized due to a change in the blank period according to a change in the frame rate (see FIG. 5). Thus, a drive method for increasing quality is required in second drive (for example, referred to as free-sync drive or G-sync drive) including a pixel structure of FIG. 3 and pixel drive of FIG. 4

Figure 3:
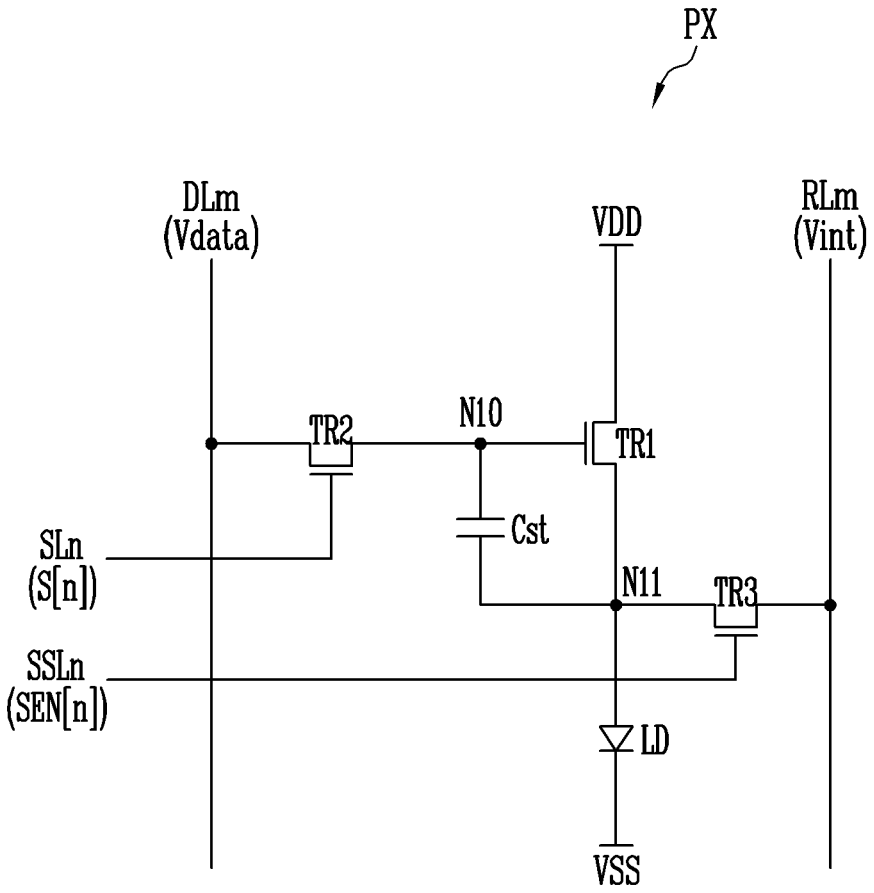
FIG. 3 is a circuit diagram illustrating an example of a pixel included in the display device of FIG. 1.

FIG. 3 is a circuit diagram illustrating an example of the pixel included in the display device of FIG. 1. FIG. 4 is a waveform diagram illustrating an example of operation of the pixel of FIG. 3. In FIGS. 3 and 4, the pixel connected to the $n^{th}$ scan line SLn and the $m^{th}$ data line DLm (n and m are natural numbers) is illustrated for the sake of convenient description.

Referring to FIGS. 3 and 4, the pixel PX may include a first transistor TR1 (or drive transistor), a second transistor TR2, a third transistor TR3, a storage capacitor Cst, and a light emitting element LD.

A first electrode of the first transistor TR1 may be connected to the first drive power VDD, and a second electrode may be connected to an anode electrode of the light emitting element LD. A gate electrode of the first transistor TR1 may be connected to a tenth node N10. The first transistor TR1 may control a current flowing through the light emitting element LD in response to a voltage of the tenth node N10. In addition, the first transistor TR1 may transfer a sensing current corresponding to a voltage charged in the storage capacitor Cst to the eleventh node N11.

A first electrode of the second transistor TR2 may be connected to the data line DLm, and a second electrode thereof may be connected to the tenth node N10. A gate electrode of the second transistor TR2 may be connected to the $n^{th}$ scan line SLn. The second transistor TR2 may be turned on when a scan signal S[n] is supplied to the $n^{th}$ scan line SLn, receive a data signal (or data voltage Vdata) from the data line DLm, and transfer the data signal to the tenth node N10.

A first electrode of the third transistor TR3 may be connected to the $m^{th}$ readout line RLm, and a second electrode thereof may be connected to the eleventh node N11 (or the second electrode of the first transistor TR1).

A gate electrode of the third transistor TR3 may be connected to an $n^{th}$ sensing line SSLn. When the third transistor TR3 is turned on in response to a sensing signal SEN[n], a reference voltage Vint may be supplied to the eleventh node N11 through the $n^{th}$ readout line RLm. The reference voltage Vint may serve to set a voltage of the second electrode (for example, a source electrode) of the first transistor TR1 to a constant value or to initialize the voltage. Accordingly, reliability of a drive current generated from the first transistor TR1 may be increased.

In addition, the reference voltage Vint may be set to be less than or equal to a voltage of the second drive power VSS. Accordingly, when the reference voltage Vint is supplied to the eleventh node N11, the light emitting element LD does not emit light (light emission-off).

In another embodiment, when turned on in response to the sensing signal SEN[n], the third transistor TR3 may transfer a sensing current to the $m^{th}$ readout line RLm. The sensing current may be provided to the compensator 500 (refer to FIG. 1). For example, the sensing current may be used to calculate the amount of change in mobility and a threshold voltage of the first transistor TR1. The mobility and threshold voltage information may be calculated according to a relationship between the sensing current and a voltage for sensing.

The storage capacitor Cst may be connected between the tenth node N10 (or the gate electrode of the first transistor TR1) and the anode electrode (or the second electrode of the first transistor TR1) of the light emitting element LD. The storage capacitor Cst may store a difference value between a voltage of the tenth node N10 and a voltage of the eleventh node N11.

An anode electrode of the light emitting element LD may be connected to the second electrode of the first transistor TR1, and a cathode electrode thereof may be connected to the second drive power VSS. The light emitting element LD may generate light of a predetermined luminance in response to a current supplied from the first transistor TR1.

Meanwhile, in the embodiment of the present disclosure, the pixel PX is not limited to the circuit structure illustrated in FIG. 3. For example, the pixel PX may be implemented as one of various circuits that receive at least one of a scan signal, a light emission control signal, and a sensing signal.

As illustrated in FIG. 4, driving of each pixel PX may include an active period AP and a blank period BP. The active period AP may include a scan period SP.

In one embodiment, when the display device 1000 is driven at a drive frequency lower than a maximum frame rate set in the display device 1000, the blank period BP may include a light emission-off period OFP.

The light emission-off period OFP may be performed within the blank period BP. During the light emission-off period OFP, a sensing signal SEN[n] may be supplied to the nth sensing line SSLn to turn on the third transistor TR3. Accordingly, the reference voltage Vint may be supplied to the eleventh node N11.

In this case, a scan signal is not supplied to the $n^{th}$ scan line SLn (that is, the scan signal has a gate-off level), and the second transistor TR2 is in a turn-off state.

When the reference voltage Vint is supplied to the eleventh node N11, light emission of the light emitting element LD may be momentarily stopped. Accordingly, luminance of the pixel PX may be reduced momentarily. In this case, a current path through the first transistor TR1 and the third transistor TR3 may be formed. In one embodiment, the reference voltage Vint may be less than or equal to a voltage of the second drive power VSS.

When the light emission-off period OFP elapses, a current generated by the first transistor TR1 may be supplied to the light emitting element LD to cause the light emitting element LD to emit light again. In one embodiment, the light emission-off period OFP is a short period less than one horizontal period, and luminance after the light emission-off period OFP may have a level similar to luminance before the light emission-off period OFP.

Meanwhile, the light emission-off periods OFP may be sequentially performed for each pixel row. However, this is an example, and the light emission-off periods OFP may also be simultaneously performed for preset pixel rows.

Thereafter, a data signal (or a data voltage Vdata) may be supplied to the pixel PX during the active period AP, and the light emitting element LD may emit light with luminance corresponding to the data signal (or the data voltage Vdata).

In one embodiment, during the scan period SP of the active period AP, a sensing signal SEN[n] and a scan signal S[n] may be respectively supplied to the nth sensing line SSLn and the nth scan line SLn. In addition, the data signal (or the data voltage Vdata) may be supplied to the data line DLm during the scan period SP. Then, the second transistor TR2 may be turned on to supply the data signal (or the data voltage Vdata) to the tenth node N10, and the third transistor TR3 may be turned on to supply the reference voltage Vint to the eleventh node N11.

Accordingly, a voltage corresponding to a difference between a voltage of the data signal (or the data voltage Vdata) and the reference voltage Vint may be stored in the storage capacitor Cst.

Meanwhile, the reference voltage Vint is supplied to the eleventh node N11 even during the scan period SP, and thus, light emission of the light emitting element LD may be momentarily stopped. In this case, a current path through the first transistor TR1 and the third transistor TR3 may be formed. Accordingly, luminance of the pixel PX may be reduced momentarily.

In one embodiment, the scan periods SP may be sequentially performed for each pixel row or may be simultaneously performed for preset pixel rows.

After the scan period SP, the second and third transistors TR2 and TR3 may be turned off. The light emitting element LD may emit light with luminance corresponding to the voltage stored in the storage capacitor Cst. During the active period AP after the scan period SP, an effective image to be substantially displayed in the corresponding frame may be displayed.

FIG. 5 is a diagram illustrating an example of a change in luminance of an image according to a frame rate.

Referring to FIGS. 1, 2, 4, and 5, luminance of a display device that displays an image in a variable frame rate driving method may change according to a change in a frame rate for the same gray level.

During the scan period SP of the active period AP, an image may be displayed in black for a very short time due to non-emission of the light emitting element LD. Thus, as illustrated in FIG. 5, a period in which luminance corresponding to the scan period SP is reduced may be generated.

FIG. 5 illustrates a change in luminance according to a frame rate during the same time period in the frame rate driving method of related art. For example, the scan period SP may be repeated ten times for the same time under a condition of a frame rate of 240 Hz, and the scan period SP may be repeated five times for the same time under a condition of a frame rate of 120 Hz, and the scan period SP may be repeated twice under a condition of a frame rate of 48 Hz.

In this way, as the number of repetitions of the scan period SP increases, average luminance for the same gray level may decrease. That is, as illustrated in FIG. 5, for the same gray level, average luminance of a frame rate driving of 240 Hz may be lower than average luminance of frame rate driving of 120 Hz. Likewise, for the same gray level, the average luminance of the frame rate driving of 120 Hz may be lower than average luminance of frame rate driving of 48 Hz.

In order to reduce or minimize a luminance variation according to a frequency difference between the scan periods SP, the display device 1000 and a driving method thereof according to the embodiments of the present disclosure may have an additional light emission-off period OFP inserted into the blank period BP for driving at a frame rate lower than the maximum frame rate set in the display device 1000 (see FIG. 4 and FIGS. 7, 8, and 9).

In terms of luminance, the scan period SP has substantially the same luminance lowering role as the light emission-off period OFP, and thus, the scan period SP may also be understood as a kind of light emission-off period OFP. Thus, when the numbers of the light emission-off periods OFP included in the same period (that is, the sum of the number of scan periods SP and the light emission-off periods OFP) for various frame rates are the same as each other, the luminance variation may be reduced.

Figure 6:
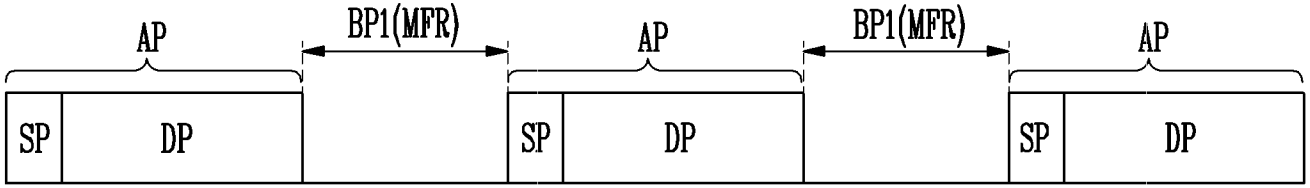
FIG. 6 is a diagram illustrating an example of operation of the display device of FIG. 1 at a maximum frame rate.

FIG. 6 is a diagram illustrating an example of operation of the display device of FIG. 1 at the maximum frame rate.

Referring to FIGS. 1, 3, and 6, a frame including the active period AP and the first blank period BP1 may be repeated under a driving condition of a maximum frame rate MFR. According to the embodiments, FIG. 6 may be understood as schematically illustrating driving of one pixel or one pixel row.

The first blank period BP1 may correspond to the maximum frame rate MFR set in the display device 1000. The maximum frame rate MFR may be determined by a rule between the display device 1000 and an external graphic processor. For example, the maximum frame rate MFR may be set to 240 Hz.

In addition, the first blank period BP1 may correspond to the maximum frame rate MFR, and the blank period of the display device 1000 may not be shorter than the first blank period BP1.

In one embodiment, the active period AP may include the scan period SP and a display period DP. The timing controller 400 may generate a count signal by counting lengths of the first blank periods BP1. The timing controller 400 may detect a length of time of the first blank period BP1 by counting the number of clocks of a clock signal supplied during the blank period.

In one embodiment, when a count value included in the count signal reaches a reference value, the timing controller 400 may supply a start signal for outputting a sensing signal (for example, the $n^{th}$ sensing signal SEN[n]) to the scan driver 100. Here, the reference value may be a length of the first blank period BP1. Thus, in a case in which the display device 1000 is driven at the maximum frame rate MFR, when the blank period (that is, the first blank period BP1) ends, the scan period SP may be performed. During the scan period SP, the same operation as in the scan period SP described with reference to FIGS. 3 and 4 may be performed.

The data signal (or the data voltage Vdata) may be written to the pixel PX by the operation of the scan period SP, and the light emitting element LD may be momentarily turned off. In the maximum frame rate MFR, one frame may include one scan period SP.

Figure 7:
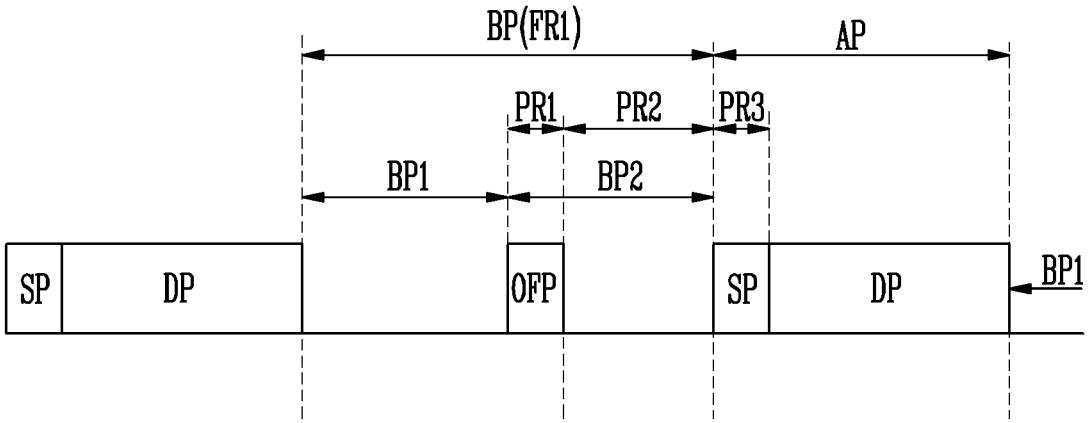
FIG. 7 is a diagram illustrating an example of operation of the display device of FIG. 1.

FIG. 7 is a diagram illustrating an example of operation of the display device of FIG. 1.

Referring to FIGS. 1, 3, 6, and 7, the display device 1000 may display an image at a first frame rate FR1 less than the maximum frame rate MFR.

FIG. 7 illustrates an example of signals supplied to one pixel (for example, the pixel PX of FIG. 3). In FIG. 7 and below, signals supplied to one pixel (for example, the pixel PX of FIG. 3 or a pixel in a first pixel row) will be mainly described. Driving such as signal supply of FIG. 7 may be performed sequentially for each predetermined pixel row or may be simultaneously performed to all pixel rows or some pixel rows.

In one embodiment, the timing controller 400 may detect the first frame rate FR1 by counting lengths of time of the blank periods BP. The lower the frame rate, the longer the blank period BP. A blank period after the first blank period BP1 may be defined as a second blank period BP2.

In one embodiment, the first frame rate FR1 may correspond to half of the maximum frame rate MFR. Thus, the blank period BR may be approximately twice as large as the first blank period BP1, and a length of the first blank period BP1 may be substantially equal to a length of the second blank period BP2. For example, the maximum frame rate MFR may be 240 Hz, and the first frame rate FR1 may be 120 Hz.

As described above, when a count value included in a count signal reaches a reference value during the blank period BP, the light emission-off period OFP may be activated. That is, as illustrated in FIG. 7, the light emission-off period OFP may be included in the second blank period BP2. For example, the count value may correspond to the length of the first blank period BP1. Accordingly, the light emission-off period OFP may be activated immediately after the first blank period BP1 ends.

During the first period PR1 (that is, the light emission-off period OFP) included in the second blank period BP2, the same operation as in the light emission-off period OFP described with reference to FIGS. 3 and 4 may be performed. The second blank period BP2 may include the second period PR2 after the first period PR1 and the light emission-off period OFP end.

During the light emission-off period OFP, the third transistor TR3 may be turned on to supply the reference voltage Vint to the eleventh node N11, and the light emitting element LD may be momentarily turned off. During the second period PR2 after the first period PR1, the light emitting element LD may emit light again based on a current generated during the light emission-off period OFP.

Thereafter, during a third period PR3 corresponding to the scan period SP of the active period AP, the second and third transistors TR2 and TR3 may be turned on to supply the reference voltage Vint to the eleventh node, and the light emitting element LD may be momentarily turned off again. After the third period PR3, the light emitting element LD may emit light with luminance corresponding to the data signal supplied during the third period PR3.

For example, the light emission-off period OFP is additionally inserted in the driving of 120 Hz of FIG. 5 according to the driving as illustrated in FIG. 7, the number of turn-offs of the light emitting element LD increases in real time, and average luminance of driving of 120 Hz may be reduced. For example, in the driving of 120, the light emission-off period OFP may be additionally inserted five times during one frame. Due to this, the average luminance of the driving of 240 Hz may be similar to the average luminance of the driving of 120 Hz under the same gray level condition.

In this way, the light emission-off period OFP is additionally inserted during the blank period BP without frame delay according to a change in the frame rate lower than the maximum frame rate MFR, and thereby, luminance fluctuation due to variation of the drive frequency (frame rate) may be reduced.

Figure 8:
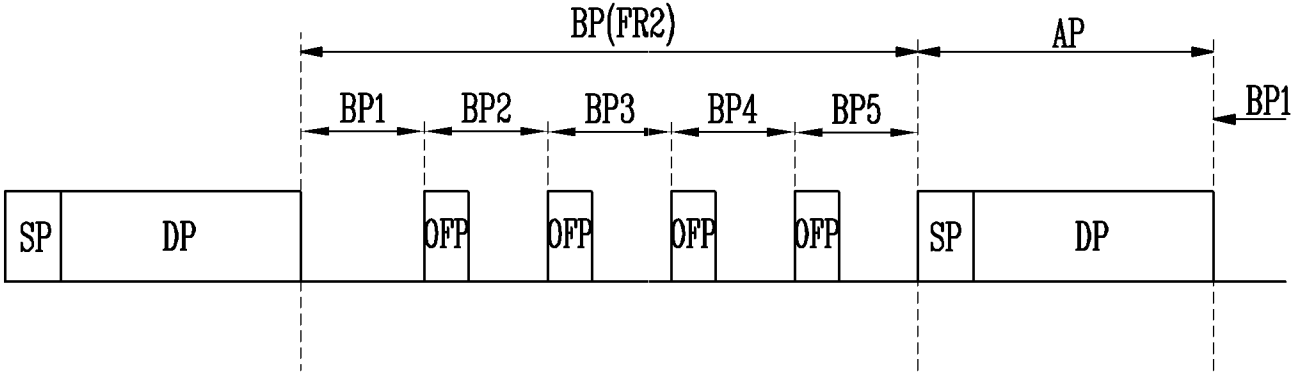
FIG. 8 is a diagram illustrating another example of the operation of the display device of FIG. 1.

FIG. 8 is a diagram illustrating another example of operation of the display device of FIG. 1.

Referring to FIGS. 1, 3, 6, 7, and 8, the display device 1000 may display an image at the second frame rate FR2 which is less than the maximum frame rate MFR.

The second frame rate FR2 is less than the first frame rate FR1. For example, when the maximum frame rate MFR is 240 Hz, the second frame rate FR2 of FIG. 8 may be 48 Hz, which is ⅕ of the maximum frame rate MFR. Alternatively, a length of the blank period BP may be 5 times the length of the first blank period BP1. In this case, the lengths of the first to fifth blank periods BP1, BP2, BP3, BP4, and BP5 may be substantially equal to each other.

In one embodiment, the light emission-off period OFP may be activated whenever a value of the count signal reaches a reference value (that is, the length of time of the first blank period BP1).

The light emission-off period OFP is additionally inserted in the driving of 48 Hz of FIG. 8 according to the driving illustrated in FIG. 8, the number of turn-offs of the light emitting element LD may increase in real time, and average luminance in the driving of 48 Hz may be reduced. For example, the light emission-off period OFP may be additionally inserted eight times in the driving of 48 Hz during one frame. Due to this, average luminance of the driving of 240 Hz may be similar to average luminance of the driving of 48 Hz under a condition of the same gray level.

Figure 9:
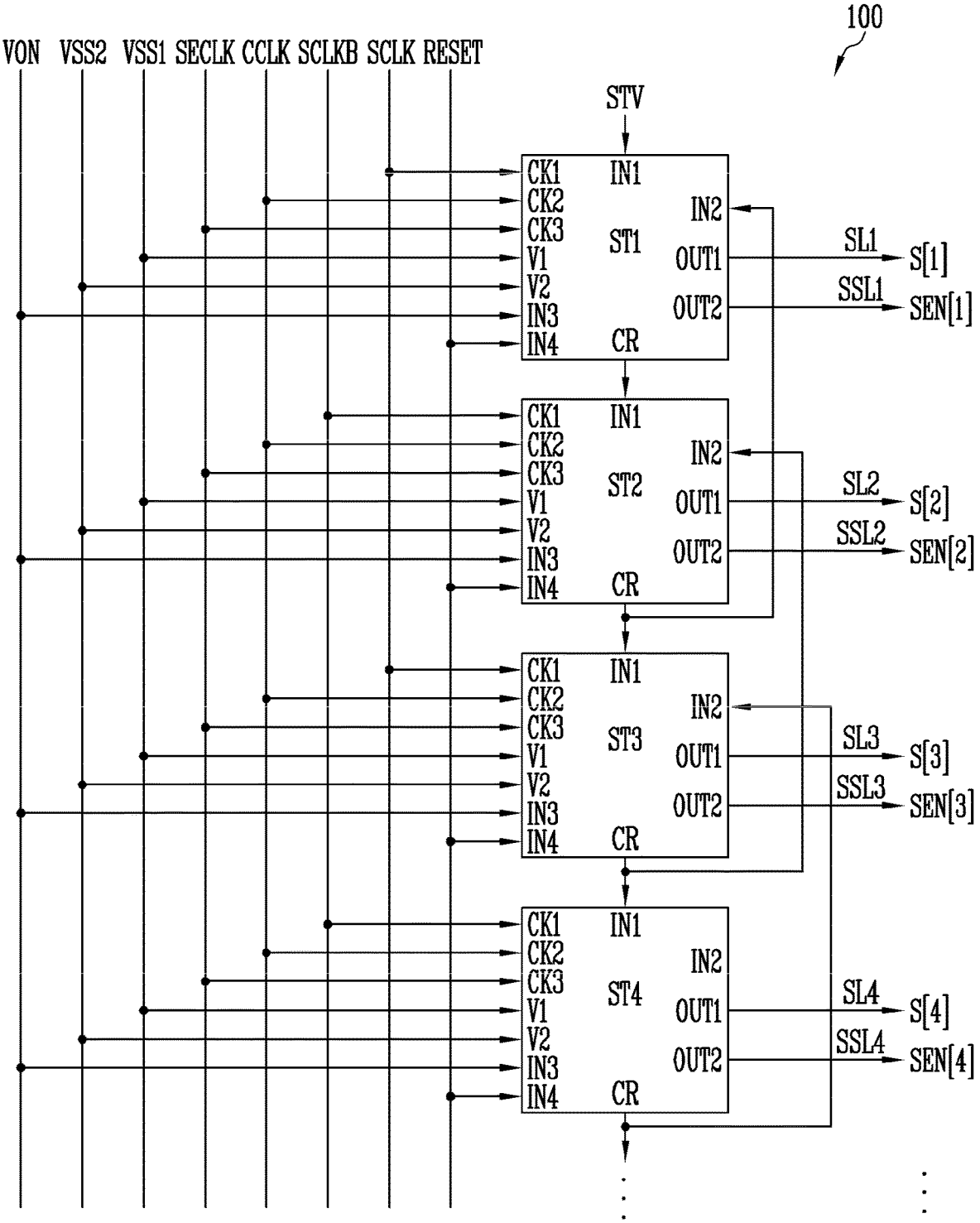
FIG. 9 is a diagram illustrating a scan driver according to an embodiment of the present disclosure.

FIG. 9 is a diagram illustrating a scan driver according to an embodiment of the present disclosure.

Referring to FIG. 9, the scan driver 100 may include a plurality of stages ST1, ST2, ST3, and ST4.

The stages ST1, ST2, ST3, and ST4 may output scan signals S[1], S[2], S[3], and S[4] in response to a scan start signal SW and/or a carry signal CR. The scan start signal SW for controlling timing of a first scan signal may be supplied to the first stage ST1.

Each of the stages ST1, ST2, ST3, ST4, and STn may include a first input terminal IN1, a second input terminal IN2, a third input terminal IN3, a fourth input terminal IN4, a scan clock input terminal CK1, a carry clock input terminal CK2, a sensing clock input terminal CK3, a first power input terminal V1, a second power input terminal V2, a carry output terminal CR, a first output terminal OUT1, and a second output terminal OUT2.

The scan clock input terminal CK1 may receive first and second scan clock signals SCLK and SCLKB corresponding to outputs of the scan signals S[1], S[2], S[3], S[4]. For example, each of the stages ST1, ST2, ST3, and ST4 may receive the first scan clock signal SCLK or the second scan clock signal SCLKB through the scan clock input terminal CK1. For example, the odd-numbered stages ST1 and ST3 may receive the first scan clock signal SCLK, and the even-numbered stages ST2 and ST4 may receive the second scan clock signal SCLKB.

The first scan clock signal SCLK may be set as a square wave signal that repeats a logic high level and a logic low level. Here, the logic high level may correspond to a gate-on voltage, and the logic low level may correspond to a gate-off voltage. For example, the logic high level may be a voltage value between approximately 10 V and approximately 30 V, and the logic low level may be a voltage value between approximately −16 V and approximately −3 V.

The second scan clock signal SCLKB may be set as a square wave signal that repeats a logic high level and a logic low level. In one embodiment, the second scan clock signal SCLKB may have the same cycle as the first scan clock signal SCLK and may be set as a signal of which a phase is inverted. However, a waveform relationship between the first scan clock signal SCLK and the second scan clock signal SCLKB is not limited thereto. For example, some of a logic high level period of the first scan clock signal SCLK may overlap some of a logic high level period of the second scan clock signal SCLKB.

The carry clock input terminal CK2 may receive a carry clock signal CCLK corresponding to outputs of carry signals CR[1], CR[2], CR[3], and CR[4].

The sensing clock input terminal CK3 may receive a sensing clock signal SECLK corresponding to outputs of sensing signals SEN[1], SEN[2], SEN[3], and SEN[4].

In one embodiment, the corresponding scan clock signals SCLK and SCLKB, the carry clock signal CCLK, and the sensing clock signal SECLK may be output at different timings during a predetermined sensing period and may have different widths and periods.

The first input terminal IN1 may receive the scan start signal SW or a carry signal of a previous stage. That is, the scan start signal SW may be supplied to the first input terminal IN1 of the first stage ST1, and the carry signal of a previous stage may be applied to the first input terminal IN1 in each of the stages other than the first stage ST1.

The second input terminal IN2 may receive a carry signal of a next stage. For example, the carry signal of the next stage may be one of carry signals that are supplied after a predetermined time after the carry signal of the current stage is output.

The third input terminal IN3 may receive a control voltage VON. In one embodiment, the control voltage VON may be a high potential voltage for being supplied to a source electrode of a predetermined transistor included in each of the stages ST1, ST2, ST3, and ST4. For example, the control voltage VON may be a constant voltage near a logic high level (gate-on voltage) of the first scan clock signal SCLK. As an example, the control voltage VON may have a voltage value between approximately 10 V and approximately 30 V. In one embodiment, the control voltage VON may be the same as the scan clock signal SCLK or SCLKB. For example, each of the stages ST1, ST2, ST3, and ST4 may receive the same clock signal through the scan clock input terminal CK1 and the third input terminal IN3.

The fourth input terminal IN4 may receive a reset signal RESET. According to one embodiment, first nodes N1 (refer to FIG. 10) of all stages ST1, ST2, ST3, and ST4 may simultaneously receive a second power VSS2 in response to the reset signal RESET. As described above, by providing the scan start signal SW and the reset signal RESET through separate input terminals, an effect that it is not necessary to configure the first stage ST1 as a dummy stage may be expected.

The carry output terminal CR may output a carry signal. The carry signal may be provided to the first input terminal IN1 of the next stage.

The first output terminals OUT1 may output the scan signals S[1], S[2], S[3], and S[4]. The scan signals S[1], S[2], S[3], and S[4] may be supplied to the pixels PX through the scan lines SL1, SL2, SL3, and SL4 corresponding thereto.

The second output terminals OUT2 may output the sensing signals SEN[1], SEN[2], SEN[3], and SEN[4]. The sensing signals SEN[1], SEN[2], SEN[3], and SEN[4] may be supplied to the pixels PX through the sensing lines SSL1, SSL2, SSL3, and SSL4 corresponding thereto.

The first power input terminal V1 may receive a first power VSS1, and the second power input terminal V2 may receive a second power VSS2. The first power VSS1 and the second power VSS2 may be set as a gate-off voltage. In one embodiment, the first power VSS1 and the second power VSS2 may be the same as each other. In addition, in one embodiment, a voltage level of the second power VSS2 may be lower than a voltage level of the first power VSS1. For example, the first power VSS1 may be set within a range of approximately −14 V to approximately −1 V, and the second power VSS2 may be set within a range of approximately −16 V to approximately −3 V.

Figure 10:
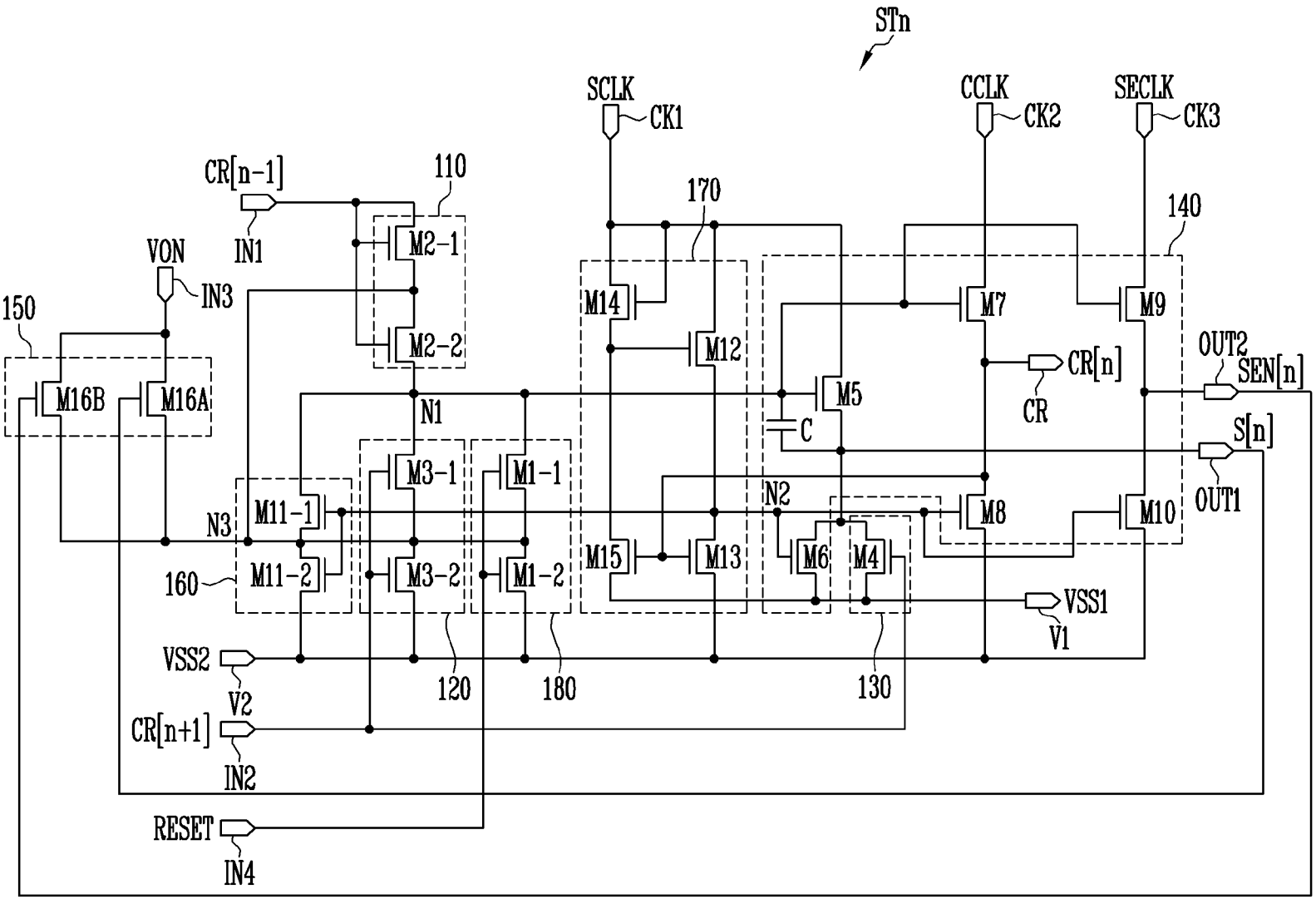
FIG. 10 is a circuit diagram illustrating an embodiment of a stage included in the scan driver of FIG. 9.

FIG. 10 is a circuit diagram illustrating an embodiment of a stage included in the scan driver of FIG. 9.

Referring to FIGS. 9 and 10, the $n^{th}$ stage STn (n is a natural number) may include a first input unit 110, a second input unit 120, a first controller 130, an output unit 140, a leakage controller 150, a second controller 160, a third controller 170, and a reset unit 180.

In one embodiment, transistors included in the $n^{th}$ stage STn may be oxide semiconductor transistors. That is, semiconductor layers (active patterns) of the transistors may be formed of an oxide semiconductor.

The first input unit 110 may control a voltage of a first node N1 in responds to a carry signal CR[n−1] of a previous stage or the scan start signal STV of FIG. 9 supplied to the first input terminal IN1. The voltage of the first node N1 is a voltage for controlling outputs of the $n^{th}$ scan signal S[n], the $n^{th}$ carry signal CR[n], and the $n^{th}$ sensing signal SEN[n]. For example, the voltage of the first node N1 is a voltage for controlling pull-up of the $n^{th}$ scan signal S[n], the $n^{th}$ carry signal CR[n], and the $n^{th}$ sensing signal SEN[n].

In one embodiment, the first input unit 110 may include a plurality of second transistors M2-1 and M2-2 connected in series and disposed between the first input terminal IN1 and the first node N1. Gate electrodes of the second transistors M2-1 and M2-2 may be connected in common to the first input terminal IN1. That is, the second transistors M2-1 and M2-2 may have a dual gate structure, and each of the second transistors M2-1 and M2-2 may have a diode connection structure. The first input unit 110 may provide a gate-on voltage (for example, a logic high level) of the n−1th carry signal CR[n−1] to the first node N1. For example, the first input unit 110 may precharge a voltage of the first node N1 by using the gate-on voltage of the $n-1^{th}$ carry signal CR[n−1].

A common node (for example, a source electrode of the transistor M2-1 and a drain electrode of the transistor M2-2) disposed between the second transistors M2-1 and M2-2 may correspond to a third node N3. That is, the common node between the second transistors M2-1 and M2-2 may be electrically connected to the third node N3.

The second input unit 120 may control the voltage of the first node N1 in response to a carry signal of a next stage (that is, an n+1th carry signal CR[n+1]). In one embodiment, the second input unit 120 may provide a voltage of the second power VSS2 to the first node N1 in response to the n+1th carry signal CR[n+1]. For example, the second input unit 120 may discharge the voltage of the first node N1 having a predetermined high potential voltage.

The second input unit 120 may include a plurality of third transistors M3-1 and M3-2 connected in series and disposed between the first node N1 and the second power input terminal V2. Gate electrodes of the third transistors M3-1 and M3-2 may be connected in common to the second input terminal IN2.

The common node between the third transistors M3-1 and M3-2 may be electrically connected to the third node N3. That is, the common node between the third transistors M3-1 and M3-2 may correspond to the third node N3.

The first controller 130 may control a voltage of the first output terminal OUT1 that outputs the $n^{th}$ scan signal S[n] in response to the n+1th carry signal CR[n+1]. A voltage of the second node N2 may control a state of the $n^{th}$ scan signal S[n] and a state of a gate-off voltage (logic low level). For example, the voltage of the second node N2 is a voltage for controlling pull-down of the $n^{th}$ scan signal S[n] and the $n^{th}$ carry signal S[n].

In one embodiment, the first controller 130 may provide a voltage of the first power VSS1 to the first output terminal OU in response to the n+1th carry signal CR[n+1].

In one embodiment, the first controller 130 may include a fourth transistor M4 connected between the first output terminal OUT1 and the first power input terminal V1. A gate electrode of the fourth transistor M4 may be connected to the second input terminal IN2. The fourth transistor M4 may discharge a voltage of the first output terminal OUT1 to the voltage of the first power VSS1.

The output unit 140 may be connected to the scan clock input terminal CK1, the carry clock input terminal CK2, the sensing clock input terminal CK3, the first power input terminal V1, and the second power input terminal V2. The output unit 140 may output the $n^{th}$ scan signal S[n] corresponding to the scan clock signal SCLK to the first output terminal OUT1, output the $n^{th}$ carry signal CR[n] corresponding to the carry clock signal CCLK to the carry output terminal CR, and output the $n^{th}$ sensing signal SEN[n] corresponding to the sensing clock signal SECLK supplied to the sensing clock input terminal CK3 to the second output terminal OUT2, in response to the voltage of the first node N1 and the voltage of the second node N2.

That is, a waveform of the $n^{th}$ scan signal S[n], a waveform of the $n^{th}$ carry signal CR[n], and a waveform of the $n^{th}$ sensing signal SEN[n] may be independently determined according to the scan clock signal SCLK, the carry clock signal CCLK, and the sensing clock signal SECLK. In one embodiment, the output unit 140 may include fifth to tenth transistors M5, M6, M7, M8, M9, and M10 and a capacitor C.

The fifth transistor M5 may be disposed between the scan clock input terminal CK1 and the first output terminal OUT1. That is, one end of the fifth transistor M5 is connected to the scan clock input terminal CK1, and the other end of the fifth transistor M5 is connected to the first output terminal OUT1. The fifth transistor M5 may include a gate electrode which is connected to the first node N1. The fifth transistor M5 may supply a gate-on voltage to the first output terminal OUT1 in response to the voltage of the first node N1. For example, the fifth transistor M5 may function as a pull-up buffer.

The sixth transistor M6 may be disposed between the first output terminal OUT1 and the first power input terminal V1. That is, one end of the sixth transistor M6 is connected to the first output terminal OUT1, and the other end of the sixth transistor M6 is connected to the first power input terminal V1. The sixth transistor M6 may include a gate electrode which is connected to the second node N2. The sixth transistor M6 may supply a gate-off voltage to the first output terminal OUT1 in response to the voltage of the second node N2. For example, the sixth transistor M6 may hold a voltage of the first output terminal OUT1 at a gate-off voltage level (or a logic low level).

The seventh transistor M7 may be disposed between the carry clock input terminal CK2 and the carry output terminal CR. That is, one end of the seventh transistor M7 is connected to the carry clock input terminal CK2, and the other end of the seventh transistor M7 is connected to the carry output terminal CR. The seventh transistor M7 may include a gate electrode which is connected to the first node N1. The seventh transistor M7 may supply a gate-on voltage to the carry output terminal CR in response to the voltage of the first node N1. For example, the seventh transistor M7 may function as a pull-up buffer.

The eighth transistor M8 may be disposed between the carry output terminal CR and the second power input terminal V2. That is, one end of the eighth transistor M8 is connected to the carry output terminal CR, and the other end of the eighth transistor M8 is connected to the second power input terminal V2. The eighth transistor M8 may include a gate electrode which is connected to the second node N2. The eighth transistor M8 may supply a gate-off voltage to the carry output terminal CR in response to the voltage of the second node N2. For example, the eighth transistor M8 may hold a voltage of the carry output terminal CR at a gate-off voltage level (that is, a logic low level).

The ninth transistor M9 may be disposed between the sensing clock input terminal CK3 and the second output terminal OUT2. That is, one end of the ninth transistor M9 is connected to the sensing clock input terminal CK3, and the other end of the ninth transistor M9 is connected to the second output terminal OUT2. A gate electrode of the ninth transistor M9 may be connected to the first node N1. The ninth transistor M9 may supply a gate-on voltage to the second output terminal OUT2 in response to the voltage of the first node N1. For example, the ninth transistor M9 may function as a pull-up buffer.

The tenth transistor M10 may be disposed between the second output terminal OUT2 and the second power input terminal V2. That is, one end of the tenth transistor M10 is connected to the second output terminal OUT2, and the other end of the tenth transistor M10 is connected to the second power input terminal V2. The tenth transistor M10 may include a gate electrode which is connected to the second node N2. The tenth transistor M10 may supply a gate-off voltage to the second output terminal OUT2 in response to the voltage of the second node N2. For example, the tenth transistor M10 may hold a voltage of the second output terminal OUT2 at a gate-off voltage level (that is, a logic low level).

The capacitor C may be disposed between the first node N1 and the first output terminal OUT1. That is, one end of the capacitor C is connected to the first node N1, and the other end of the capacitor C is connected to the first output terminal OUT1. The capacitor C may function as a boosting capacitor. That is, when the fifth transistor M5 is turned on, the capacitor C may increase (bootstrap) the voltage of the first node N1 in response to an increase in the voltage of the first output terminal OUT1. Accordingly, the fifth transistor M5 may stably maintain a turn-on state for a predetermined period.

The second controller 160 may hold the voltage of the first node N1 as a predetermined gate-off voltage in response to the voltage of the second node N2. In one embodiment, the second controller 160 may provide the voltage of the second power VSS2 (that is, gate-off voltage) to the first node N1 in response to the voltage of the second node N2.

In one embodiment, the second controller 160 may include eleventh transistors M11-1 and M11-2 connected in series between the first node N1 and the second power input terminal V2. Gate electrodes of the eleventh transistors M11-1 and M11-2 may be connected in common to the second node N2.

A common node between the eleventh transistors M11-1 and M11-2 may be electrically connected to the third node N3. In other words, the common node between the eleventh transistors M11-1 and M11-2 may correspond to the third node N3.

Meanwhile, FIG. 10 illustrates the two second transistors M2-1 and M2-2, the two third transistors M3-1 and M3-2, and the two eleventh transistors M11-1 and M11-2, but the number of transistors connected in series respectively is not limited thereto. For example, when three or more third transistors M3 are connected in series, at least one common node between the third transistors M3 may be electrically connected to the third node N3.

The third controller 170 may control the voltage of the second node N2 in response to the scan clock signal SCLK and the $n^{th}$ carry signal CR[n]. In one embodiment, the third controller 170 may transfer the scan clock signal SCLK to the second node N2 in response to the scan clock signal SCLK and then supply a gate-off voltage to the second node N2 in response to the $n^{th}$ carry signal CR[n].

The voltage of the second node N2 may control gate-off voltage (logic low level) states of the $n^{th}$ scan signal S[n], the $n^{th}$ carry signal S[n], and the $n^{th}$ sensing signal SEN[n]. For example, the voltage of the second node N2 is a voltage for controlling pull-down of the $n^{th}$ scan signal S[n], the $n^{th}$ carry signal S[n], and the $n^{th}$ sensing signal SEN[n].

The third controller 170 may include twelfth to fifteenth transistors M12, M13, M14, and M15.

The twelfth transistor M12 may be disposed between the scan clock input terminal CK1 and the second node N2. That is, one end of the twelfth transistor M12 is connected to the scan clock input terminal CK1, and the other end of the twelfth transistor M12 is connected to the second node N2. A gate electrode of the twelfth transistor M12 may be connected to a common node which is disposed between the fourteenth and fifteenth transistors M14 and M15. The twelfth transistor M12 may supply the scan clock signal SCLK to the second node N2 in response to the scan clock signal SCLK.

The thirteenth transistor M13 may be disposed between the second node N2 and the second power input terminal V2. That is, one end of the thirteenth transistor M13 is connected to the second node N2, and the other end of the thirteenth transistor M13 is connected to the second power input terminal V2.

The fourteenth and fifteenth transistors M14 and M15 may be connected in series, and disposed between the scan clock input terminal CK1 and the first power input terminal V1. A gate electrode of the fourteenth transistor M14 may be disposed to the scan clock input terminal CK1. That is, one end of the fourteenth transistor M14 is connected to the scan clock input terminal CK1, and the other end of the fourteenth transistor M14 is connected to the first power input terminal V1. Gate electrodes of the thirteenth and fifteenth transistors M13 and M15 may be connected in common to the carry output terminal CR.

That is, when the $n^{th}$ carry signal CR[n] is output (when the $n^{th}$ carry signal CR[n] has a gate-on voltage), the fifteenth transistor M15 may be turned on, the twelfth transistor M12 may be turned off, and the thirteenth transistor M13 may be turned on to cause a voltage of the second power VSS2 to be supplied to the second node N2. Thus, when the $n^{th}$ carry signal CR[n] is output, the second node N2 may have a gate-off voltage.

Here, a voltage level of the second power VSS2 may be lower than a voltage level of the first power VSS1. That is, a voltage of the second power supply VSS2 lower than a voltage of the first power supply VSS1 may be provided to the second node N2 by operation of the thirteenth transistor M13. This is to prevent the sixth transistor M6 and/or the eighth transistor M8 from performing unintended operation due to ripple of the voltage of the second node N2, when the voltage of the second node N2 changes from the gate-on voltage to the gate-off voltage. Thus, one electrode of the thirteenth transistor M13 may be connected to the second power supply VSS2 lower than the voltage of the first power supply VSS1.

The leakage controller 150 may include a $16A^{th}$ transistor M16A and a $16B^{th}$ transistor M16B connected and disposed between the third input terminal IN3 and the third node N3. The $16A^{th}$ transistor M16A may include a gate electrode that receives the $n^{th}$ scan signal S[n]. The $16B^{th}$ transistor M16B may include a gate electrode that receives the $n^{th}$ sensing signal SEN[n].

The $16A^{th}$ transistor M16A may supply the control voltage VON to the third node N3 in response to the $n^{th}$ scan signal S[n]. The $16B^{th}$ transistor M16B may supply the control voltage VON to the third node N3 in response to the $n^{th}$ sensing signal SEN[n]. Accordingly, when at least one of the $n^{th}$ scan signal S[n] and the $n^{th}$ sensing signal SEN[n] has a gate-on voltage, the control voltage VON may be supplied to the third node N3. Thus, the voltage of the first node N1 may be maintained without leakage of a current during a long scan-on time (sensing-on time).

The reset unit 180 may control the voltage of the first node N1 in response to the reset signal RESET. The reset unit 180 may include a 1-1th transistor M1-1 and a 1-2th transistor M1-2 and disposed between the second power input terminal V2 and the first node N1. The 1-1th transistor M1-1 and the 1-2th transistor M1-2 include gate electrodes that receive the reset signal RESET, and the gate electrodes are electrically connected to the fourth input terminal IN4. The 1-1th transistor M1-1 and the 1-2th transistor M1-2 may supply the second power VSS2 to the first node N1 in response to the reset signal RESET.

That is, when the reset signal RESET is output, the 1-1th transistor M1-1 and the 1-2th transistor M1-2 may be turned on to supply the voltage of the second power VSS2 to the first node N1. Thus, when the reset signal RESET is output, the first node N1 may have a gate-off voltage.

Figure 11:
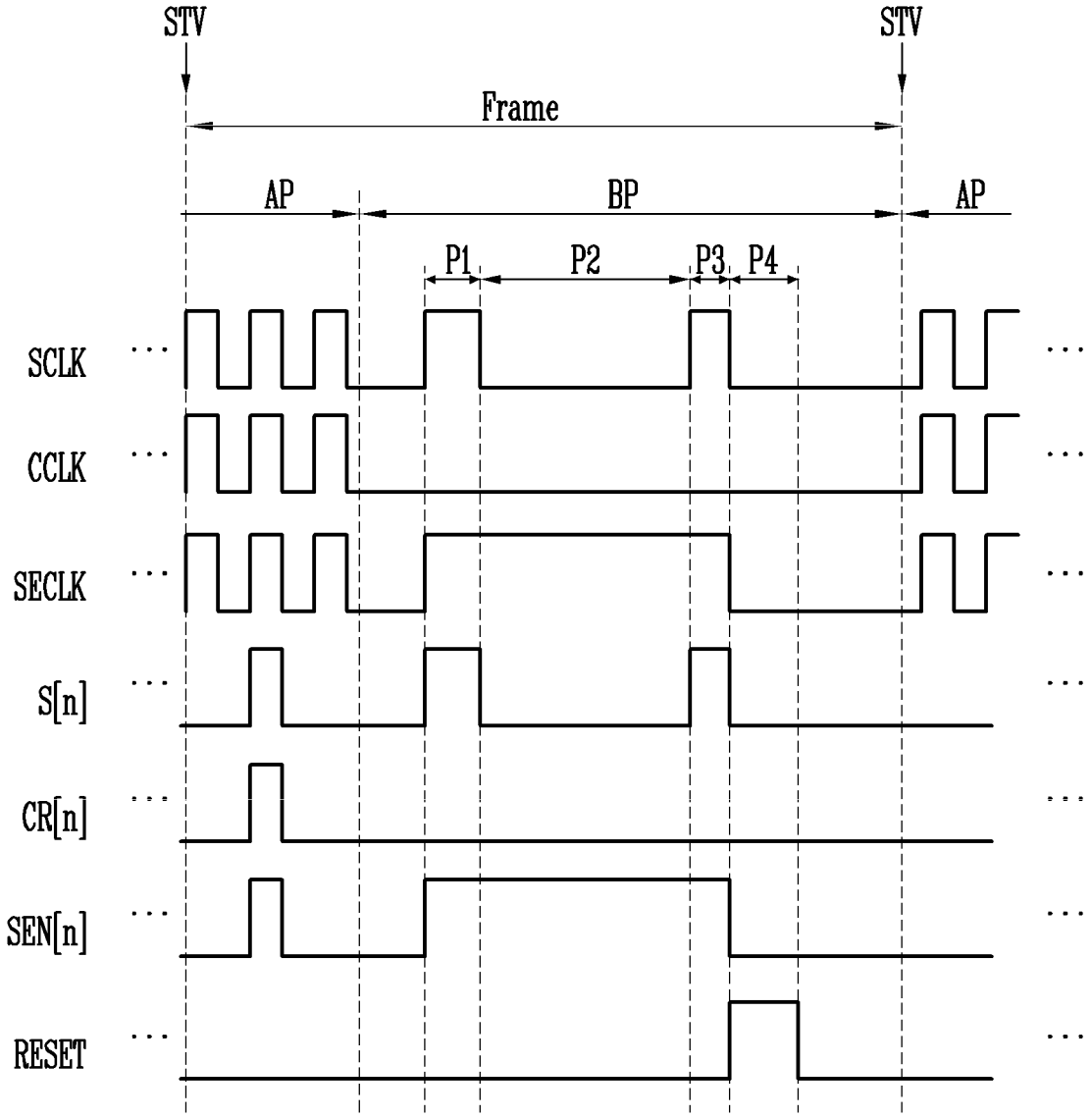
FIG. 11 is a waveform diagram illustrating operation of the stage of FIG. 10 according to the embodiment.

FIG. 11 is a waveform diagram illustrating operation of the stage of FIG. 10 according to an embodiment. According to the embodiment, the scan start signal SW may be supplied to the stage at each start point in time of a frame.

Referring to FIGS. 9, 10, and 11, a frame for displaying an image may include the active period AP and the blank period BP.

The active period AP may be a period in which the pixel PX displays an image corresponding to a data signal. In one embodiment, the scan clock signal SCLK, the carry clock signal CCLK, and the sensing clock signal SECLK may be output at the same timing during the active period AP. Accordingly, the $n^{th}$ scan signal S[n], the $n^{th}$ carry signal CR[n], and the $n^{th}$ sensing signal SEN[n] may simultaneously have a gate-on voltage. During the active period AP, a scan signal, a carry signal, and a carry signal may be sequentially supplied to pixel rows.

The blank period BP may include a sensing period in which a sensing value is extracted from the pixel PX through the readout line RLm. In one embodiment, mobility of the first transistor TR1 may be detected during the blank period BP. However, this is an example, and a change amount of a threshold voltage of the first transistor TR1 and/or a change in characteristics of an organic light emitting diode (OLED) may also be detected during the sensing period.

According to one embodiment, the blank period BP may include first to fourth periods P1, P2, P3, and P4. As illustrated in FIG. 11, timings of the scan clock signal SCLK, the carry clock signal CCLK, and the sensing clock signal SECLK are different from each other during the blank period BP. For example, the scan clock signal SCLK may have a gate-on voltage during the first period P1 and the third period P3 and a gate-off voltage during the second period P2 and the third period P3. Furthermore, the sensing clock signal SECLK may have a gate-on voltage during the first to third periods P1, P2, and P3, and have a gate-off voltage during the fourth period P4. The carry clock signal CCLK has a gate-off voltage throughout the first to fourth periods P1, P2, P3, and P4 of the blank period BP. Because a sensing operation in the blank period BP is performed for only one pixel row, the carry signal is not output. Thus, the carry clock signal CCLK and the $n^{th}$ carry signal CR[n] may hold the gate-off voltage.

In one embodiment, the reset signal RESET may hold the gate-on voltage during the fourth period P4.

The first period P1 may be a data signal input period for sensing. During the first period P1, the $n^{th}$ scan signal S[n] and the $n^{th}$ sensing signal SEN[n] may have the gate-on voltage.

The second period P2 may be a current sensing period. That is, a current sensed by the $n^{th}$ sensing signal SEN[n] having the gate-on voltage may be transferred to the compensator 500 of FIG. 1 through the readout line RLm.

The third period P3 may be a data rewrite period. In this case, the $n^{th}$ scan signal S[n] may have the gate-on voltage again. The $n^{th}$ sensing signal SEN[n] may hold the gate-on voltage. A data signal of the current frame may be applied to the pixel PX again. Thus, the pixel PX may emit light again with the luminance that is emitted during the active period AP of the current frame.

The fourth period P4 may be a reset period of the first node N1. During the fourth period P4, 16-1th and 16-2th transistors M16-1 and M16-2 may be turned on by the reset signal RESET having the gate-on voltage to supply the second power VSS2 to the first node N1. Because the sensing operation in the blank period BP according to an embodiment is performed for only one pixel row, a carry signal may not be output. Thus, the voltage of the first node N1 may be maintained as it is without being discharged by a carry signal (that is, the n+1th carry signal CR[n+1]) of the next stage. This may cause deterioration of transistors (for example, the 2-2th transistor M2-2, the 3-1th transistor M3-1, the fifth transistor M5, and the 11-1th transistor M11-1) connected to the first node N1.

According to the embodiment of the present disclosure, the stage may reset the voltage of the first node N1 to the voltage of the second power VSS2 immediately after the sensing period ends. Accordingly, the first node N1 of the stage in which the sensing operation is performed may be reset periodically. In other words, deterioration of the transistors (for example, the 2-2th transistor M2-2, the 3-1th transistor M3-1, the fifth transistor M5, and the $11\text{-}1^{th}$ transistor M11-1) connected to the first node N1 may be minimized.

On the contrary, when the first node N1 of the stage is reset by using the scan start signal STV (see FIG. 9) every time a frame starts (or every time a scan signal and/or a sensing signal is output), the blank period BP is also varied when a frame rate is varied, and thus, a reset cycle may become irregular. For example, because the blank period BP increases as a drive frequency is lowered, a period from the end of a sensing operation of the current frame to the start of the next frame may be lengthened. As the time when a voltage of a high level is applied to the first node N1, deterioration of the transistors (for example, the 2-2th transistor M2-2, the 3-1th transistor M3-1, the fifth transistor M5, and the 11-1th transistor M11-1) connected to the first node N1 of the stage may increase.

Figure 12:
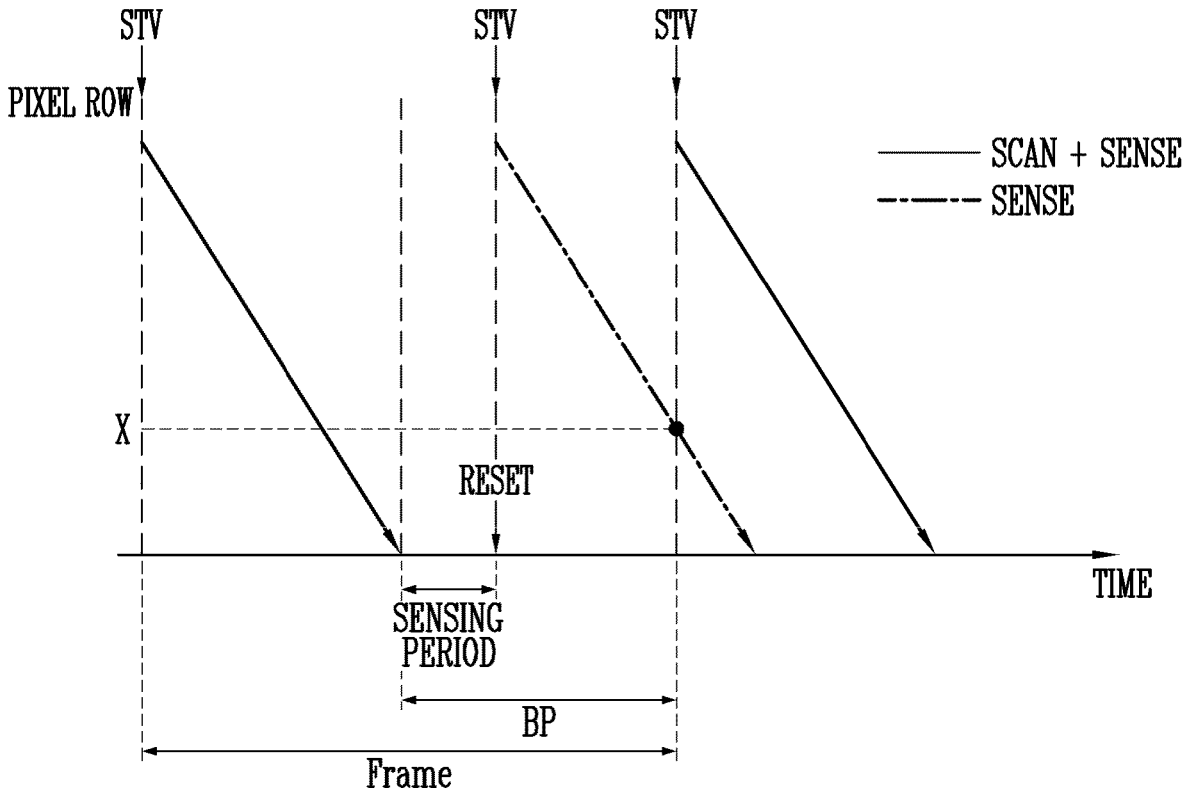
FIG. 12 is a diagram illustrating another effect of the present disclosure.

FIG. 12 is a diagram illustrating another effect of the present disclosure.

Referring to FIGS. 1, 3, 4, and 12, diagonal lines indicated by solid lines indicate that the scan periods SP are sequentially performed for each pixel row during one frame, and a diagonal line indicated by an alternate long and short dash line indicates that the light emission-off periods OFP are sequentially performed for each pixel row during one frame.

In one embodiment, the timing controller 400 may supply the scan start signal STV for starting the scan period SP or the light emission-off period OFP to the scan driver 100 at least once during one frame. Meanwhile, the timing controller 400 may supply the reset signal RESET for starting a reset period to the scan driver 100 only once during one frame. The sensing operation in the blank period BP may be performed for only one pixel row.

In this case, during the scan period SP, a scan signal (for example, S[n]) and a sensing signal (for example, SEN[n]) are respectively supplied to scan lines (for example, SL[n]) and sensing lines (for example, SSL[n]), and thereby, the second transistor TR2 and the third transistor TR3 may be turned on. Meanwhile, during the light emission-off period OFP, the sensing signal is supplied to the sensing lines, and thereby, only the third transistor TR3 may be turned on. When the third transistor TR3 is turned on, the reference voltage Vint may be supplied to the eleventh node N11 to cause light emission of the light emitting element LD to be momentarily stopped. In this case, a current path through the first transistor TR1 and the third transistor TR3 may be formed. Accordingly, luminance of the pixel PX may be reduced momentarily.

In the embodiment illustrated in FIG. 12, it is assumed that a drive frequency of the previous frame and a drive frequency of the current frame are not varied by an integer multiple. For example, a case in which the drive frequency is varied from 120 Hz to 48 Hz is represented. Meanwhile, when the drive frequency of the previous frame and the drive frequency of the current frame are varied by an integer multiple, the scan period SP and the light emission-off period OFP overlap each other at the same point in time unlike the embodiment of FIG. 12. Due to this, a targeted light emission-off period OFP may be normally performed.

When the drive frequency is varied from 120 Hz to 48 Hz, it is required to insert three additional times of the light emission-off period OFP when the drive frequency is 48 Hz compared to when the drive frequency is 120 Hz so that average luminance is not changed. That is, when the drive frequency is 120 Hz during the same time, the scan period SP may be performed five times, and when the drive frequency is 48 Hz, the scan period SP may be performed twice. Thus, when the drive frequency is 48 Hz, it may be required to insert three additional times of the light emission-off period OFP.

In this case, as illustrated in FIG. 12, a case in which the scan period SP and the light emission-off period OFP overlap each other at the same point in time may occur. As in the related art, when the first node N1 of the stage STn (see FIG. 10) is reset by the scan start signal SW every time a scan signal and/or a sensing signal is output, the light emission-off period OFP may not be performed after an Xth pixel row in which the scan period SP and the light emission-off period OFP overlap each other. That is, when the first node N1 of the stage STn is reset, a sensing signal (for example, the $n^{th}$ sensing signal SEN[n]) may not be generated, and thus the light emission-off period OFP may be stopped. Accordingly, a targeted light emission-off period OFP is not performed, thereby being recognized as a change in luminance and/or flicker of an image.

Meanwhile, according to the waveform diagram of the present disclosure illustrated in FIG. 11, the stage may reset the voltage of the first node N1 of the stage STn to the voltage of the second power VSS immediately after the sensing period ends. The first node N1 of the stage STn is not reset at the point in time when the scan signal and/or the sensing signal is output, and thus, the light emission-off period OFP may be performed for all pixel rows. Accordingly, even when a drive frequency of the previous frame and a drive frequency of the current frame are not varied by an integer multiple, the targeted light emission-off period OFP may be performed to prevent a change in luminance and/or flicker of an image.

Although the present disclosure has been described with reference to the embodiments, those skilled in the art will be able to understand that the present disclosure may be modified and changed variously without departing from the idea and scope of the present disclosure described in the following claims.

What is claimed is:

1. A display device comprising:

a plurality of pixels, each of the plurality of pixels respectively connected to scan lines, sensing lines, readout lines, and data lines;

a scan driver including a plurality of stages and configured to supply a scan signal and a sensing signal to each of the scan lines and the sensing lines, respectively;

a data driver configured to supply a data signal to each of the data lines;

a timing controller configured to divide one frame into an active period including a scan period in which the data signal is supplied to each of the data lines and a display period in which the pixels emit light in response to the data signal, and a blank period including a sensing period in which electrical characteristics of the pixels are detected and a reset period in which the stages are reset, based on an external control signal; and a compensator configured to generate a compensation value for compensating for deterioration of the pixels based on sensing values provided from the readout lines during the sensing period, wherein a start point in time of the reset period substantially coincides with an end point in time of the sensing period.

2. The display device of claim 1, wherein the sensing period is performed for at least one of the scan lines during the blank period.

3. The display device of claim 2, wherein the timing controller supplies a scan start signal for starting the scan period to the scan driver at least once during one frame, and supplies a reset signal for starting the reset period to the scan driver once during one frame.

4. The display device of claim 1, wherein the $n^{th}$ (n is a natural number) stage of the plurality of stages includes a first input unit which precharges a voltage of a first node in response to a carry signal of a previous stage supplied to a first input terminal;

a second input unit which discharges the voltage of the first node in response to a carry signal of a next stage supplied to a second input terminal;

a first controller which discharges a voltage of a first output terminal for outputting an $n^{th}$ carry signal in response to the carry signal of the next stage; and an output unit which is connected to a scan clock input terminal, a carry clock input terminal, a sensing clock input terminal, a first power input terminal to which a first power is supplied, and a second power input terminal to which a second power is supplied, and outputs an $n^{th}$ scan signal corresponding to a scan clock signal supplied to the scan clock input terminal in response to the voltage of the first node and a voltage of a second node, an $n^{th}$ carry signal corresponding to a carry clock signal supplied to the carry clock input terminal, and an $n^{th}$ sensing signal corresponding to a sensing clock signal supplied to the sensing clock input terminal in response to the voltage of the second node to the first output terminal, a carry output terminal, and a second output terminal, respectively.

5. The display device of claim 4, further comprising:

a reset unit which resets the voltage of the first node to the second power in response to a reset signal supplied to a fourth input terminal.

6. The display device of claim 5, wherein the plurality of stages simultaneously receive the reset signal.

7. The display device of claim 5, further comprising:

a leakage controller which supplies a control voltage supplied to a third input terminal to the first input unit and the second input unit in response to the $n^{th}$ scan signal and the $n^{th}$ sensing signal.

8. The display device of claim 7, further comprising:

a second controller which holds the voltage of the first node as a gate-off voltage in response to the voltage of the second node; and a third controller which controls the voltage of the second node in response to the scan clock signal and the $n^{th}$ carry signal.

9. The display device of claim 8, wherein each of the first and second input units, the first, second, and third controllers, the output unit, the leakage controller, and the reset unit is made of an oxide semiconductor transistor.

10. The display device of claim 8, wherein the reset unit includes a plurality of first transistors which are connected in series and disposed between the second power input terminal and the first node, and have gate electrodes which are connected in common to the fourth input terminal.

11. The display device of claim 10, wherein the first input unit includes a second transistor which is disposed between the first input terminal and the first node, and has a gate electrode connected to the first input terminal, the second input unit includes a third transistor which is disposed between the second power input terminal and the first node, and has a gate electrode connected to the second input terminal, the first controller includes a fourth transistor which is disposed between the first output terminal and the first power input terminal, and has a gate electrode connected to the second input terminal, and the output unit includes a firth transistor which is disposed between the clock input terminal and the first output terminal, and has a gate electrode connected to the first node, a sixth transistor which is disposed between the first output terminal and the first power input terminal, and has a gate electrode connected to the second node, a seventh transistor which is disposed between the clock input terminal and the carry output terminal, and has a gate electrode connected to the first node, an eighth transistor which is disposed between the carry output terminal and the second power input terminals, and has a gate electrode connected to the second node, a ninth transistor which is disposed between the sensing clock input terminal and the second output terminal, and has a gate electrode connected to the first node, and a tenth transistor which is disposed between the second output terminal and the second power input terminal, and has a gate electrode connected to the second node.

12. The display device of claim 11, wherein the second controller includes a ninth transistor which is disposed between the first node and the second power input terminal, and has a gate electrode connected to the second node.

13. The display device of claim 12, wherein the third controller includes a twelfth transistor disposed between the clock input terminal and the second node, a thirteenth transistor disposed between the second node and the second power input terminal, and fourteenth and fifteenth transistors arranged in series and disposed between the scan clock input terminal and the first the power input terminal, a gate electrode of the twelfth transistor is connected to a common node which is disposed between the fourteenth transistor and the fifteenth transistor, gate electrodes of the thirteenth transistor and the fifteenth transistor are connected to the carry output terminal, and a gate electrode of the fourteenth transistor is connected to the scan clock input terminal.

14. The display device of claim 13, wherein the leakage controller includes a $16A^{th}$ transistor which is disposed between the third input terminal and the third node, and has a gate electrode connected to the first output terminal; and a $16B^{th}$ transistor which is disposed between the third input terminal and the third node, and has a gate electrode connected to the second output terminal.

15. The display device of claim 5, wherein the scan clock signal, the carry clock signal, and the sensing clock signal are output at a same timing during the display period and are output at different timings during the sensing period.

16. The display device of claim 15, wherein the blank period includes a first period, a second period, a third period, and a fourth period, and the first, second, third, and fourth periods are disposed consecutively, the scan clock signal has a gate-on voltage during the first period and the third period, the sensing clock signal has a gate-on voltage during the first, second, and third periods, and the reset signal has the gate-on voltage during the fourth period.

17. The display device of claim 16, wherein the carry clock signal has a gate-off voltage during the blank period.

18. The display device of claim 1, wherein the timing controller generates a count signal in which time of the blank period is counted, and supplies a start signal for outputting the sensing signal to the scan driver when the count signal reaches a reference value.

19. The display device of claim 18, wherein the reference value is a length of a first blank period corresponding to a maximum frame rate set in the display device.

20. The display device of claim 19, wherein when a sensed frame rate based on the control signal is less than the maximum frame rate, the blank period includes the first and second blank periods, which are disposed consecutively, and the scan driver supplies the sensing signal to the sensing line during a first period included in the second blank period based on the start signal.

* * * * *